US005801635A

United States Patent [19]

Price

[11] Patent Number: 5,801,635

[45] Date of Patent: Sep. 1, 1998

[54] POWER INTERRUPTION DETECTOR

[76] Inventor: Glenn L. Price, 1622 Scott St., Clearwater, Fla. 34615

[21] Appl. No.: 800,788

[22] Filed: Feb. 14, 1997

[51] Int. Cl.[6] ..... G08B 21/00

[52] U.S. Cl. ..... 340/656; 340/635; 340/644; 340/652; 361/118

[58] Field of Search ..... 340/635, 638, 340/644, 649, 652, 653, 654, 656, 661; 361/56, 115, 111, 118

[56] References Cited

U.S. PATENT DOCUMENTS

| | | | |
|---|---|---|---|
| 4,875,152 | 10/1989 | Foster | 340/656 |
| 4,876,713 | 10/1989 | Crosby et al. | 379/412 |
| 4,947,281 | 8/1990 | Boteler | 361/56 |
| 4,999,728 | 3/1991 | Curl | 361/33 |
| 5,032,946 | 7/1991 | Misencil et al. | 361/56 |
| 5,115,368 | 5/1992 | Smith | 361/56 |
| 5,235,505 | 8/1993 | Hiruma | 363/56 |
| 5,243,648 | 9/1993 | Gilardi et al. | 380/6 |
| 5,272,587 | 12/1993 | Wan | 361/111 |
| 5,384,679 | 1/1995 | Smith | 361/119 |
| 5,650,771 | 7/1997 | Lee | 340/656 |
| 5,663,711 | 9/1997 | Sanders et al. | 340/656 |

*Primary Examiner*—Jeffery Hofsass
*Assistant Examiner*—Daniel J. Wu
*Attorney, Agent, or Firm*—Joseph N. Breaux

[57] ABSTRACT

A power interruption detector including a housing, a power input cord, a multi-volt transformer having a 120-208-240 primary winding and a 24 volt secondary winding, a power contactor with an actuating coil, a power plug receptacle, a delay timer, a counting circuit, an alarm circuit, a thumbwheel switch, a digital trip counter display driver, a display output device, an audible alarm enunciator, and a battery. The power input cord couples line power to the primary winding of the multi-volt transformer and to one side of the power contactor. The other side of the power contactor is wired to the terminals of the power plug receptacle. The power contactor has contacts that close to complete the circuit between the power input cord and the power plug receptacle when the actuating coil is energized. The secondary winding is coupled to the delay timer. The delay timer has a delay timer output coupled to the actuating coil of the contactor. The delay timer has internal circuitry that causes the delay timer output to energize the actuating coil of the contactor a predetermined delay period after the delay timer input detects current flow through the secondary winding.

3 Claims, 2 Drawing Sheets

POWER INTERRUPTION DETECTOR

TECHNICAL FIELD

The present invention relates to power interruption detectors and more particularly to a power interruption detector having a disconnect timer switch in combination with a power interruption counter that has an audible alarm output that is activated after a predetermined number of power interruptions have been detected.

BACKGROUND OF THE INVENTION

Many electrically powered devices, such as air conditioning units, can be damaged if power is reapplied immediately after a power interruption. It would be a benefit, therefore, to have a power interruption detector having an automatic reset circuit that reapplied power to a device only after a predetermined delay period had expired. Because repeated power interruptions can lead to damaged equipment, it would be a further benefit to have a power interruption detector with an automatic reset circuit that provided an audible alarm when a predetermined number of power interruptions had been detected.

SUMMARY OF THE INVENTION

It is thus an object of the invention to provide a power interruption detector that has an automatic reset circuit that includes a delay timer and that only reapplies power to a power outlet after a predetermined delay period has expired.

It is a further object of the invention to provide a power interruption detector that includes an alarm circuit that provides an audible alarm when a predetermined number of power interruptions have been detected.

It is a still further object of the invention to provide a power interruption detector that includes a trip counter display that provides a visual display of the number of power interruptions detected by the power interruption detector since the last trip counter reset.

It is a still further object of the invention to provide a power interruption detector that includes an alarm circuit that provides an audible alarm when a predetermined number of power interruptions have been detected and an alarm set input that allows the user to select the predetermined number of power interruptions from a range of values.

It is a still further object of the invention to provide a power interruption detector that accomplishes all or some of the above objects in combination.

Accordingly, a power interruption detector is provided. The power interruption detector comprises a housing, a power input cord, a multi-volt transformer having a 120-208-240 primary winding and a 24 volt secondary winding, a power contactor with an actuating coil, a power plug receptacle, a delay timer, a counting circuit, an alarm circuit, a thumb-wheel switch, a digital trip counter display driver, a display output device, an audible alarm enunciator, and a battery. The power input cord couples line power to the primary winding of the multi-volt transformer and to one side of the power contactor. The other side of the power contactor is wired to the terminals of the power plug receptacle. The power contactor has contacts that close to complete the circuit between the power input cord and the power plug receptacle when the actuating coil is energized.

The secondary winding is coupled to the delay timer. The delay timer has a delay timer output coupled to the actuating coil of the contactor. The delay timer has internal circuitry that causes the delay timer output to energize the actuating coil of the contactor a predetermined delay period after the delay timer input detects current flow through the secondary winding.

The counting circuit has a counting input coupled to the one of the terminals of the actuating coil. Each time the actuating coil is energized the counter increments one increment on the counter output lines. The counter output lines are connected to the data input lines of the digital trip counter display driver. The digital trip counter display driver drives the display output device in a manner such that the display output device visually displays in Arabic numerals the binary value of the counter output lines minus one. The alarm circuit has an alarm output connected to the activation input of the audible alarm enunciator and an alarm input connected to an output of the thumb wheel switch. The alarm output activates the audible alarm enunciator when one more than the numeric value dialed on the thumb wheel switch is reached by the counter output lines.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
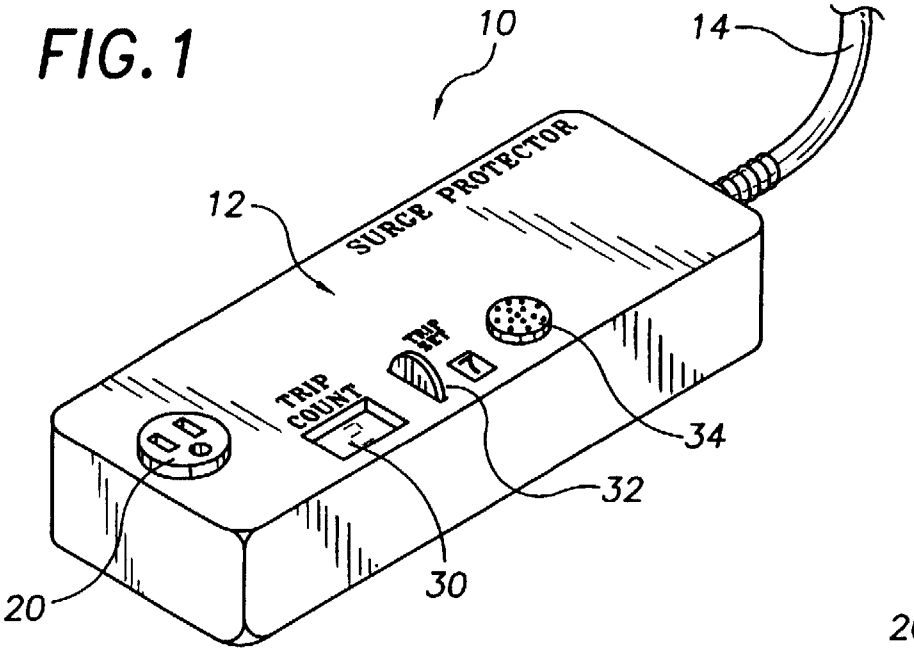
FIG. 1 is a perspective view of the exterior of an exemplary embodiment of the power interruption detector of the present invention showing the housing, the power input cord, the power plug receptacle, the thumb-wheel switch of the alarm circuit, the seven segment display, and the audible alarm enunciator.

FIG. 1 shows an exemplary embodiment of the power interruption detector of the present invention, generally designated by the numeral 10. Interruption detector 10 includes a molded plastic housing, generally designated 12 (FIGS. 1 and 2); a three conductor power input cord 14 (FIGS. 1 and 2); a multi-volt transformer, generally designated by the numeral 16 (FIGS. 2 and 3); a thirty amp power contactor, generally designated by the numeral 18 (FIGS. 2 and 3); a power plug receptacle 20 (FIGS. 1 and 2); a delay timer, generally designated by the numeral 22 (FIGS. 2 and 3); a circuit board, generally designated by the numeral 24 (FIG. 2), containing a counting circuit 26 (FIGS. 2 and 3), a combined visual digital trip counter display driver and alarm circuit 28 (FIGS. 2 and 3), and a battery 29 (FIGS. 2 and 3); a visual seven-segment display 30; a thumb-wheel switch 32 (FIGS. 1 and 3); and an audible alarm enunciator 34 (FIGS. 1 and 3).

Figure 2:
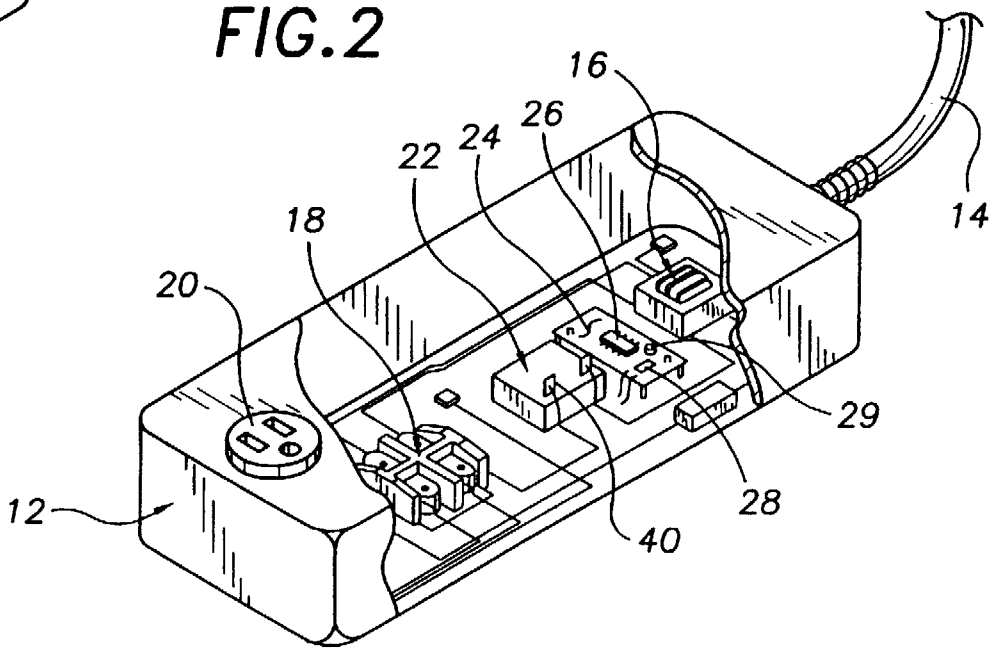
FIG. 2 is a partial cut-away view of the power interruption detector of FIG. 1 showing the housing, the power input cord, the multi-volt transformer having a 120-208-240 primary winding and a 24 volt secondary winding, the power contactor with an actuating coil, the power plug receptacle, the delay timer, and the circuit board having the counting circuit and the combined digital trip counter display driver and alarm circuits.
Figure 3:
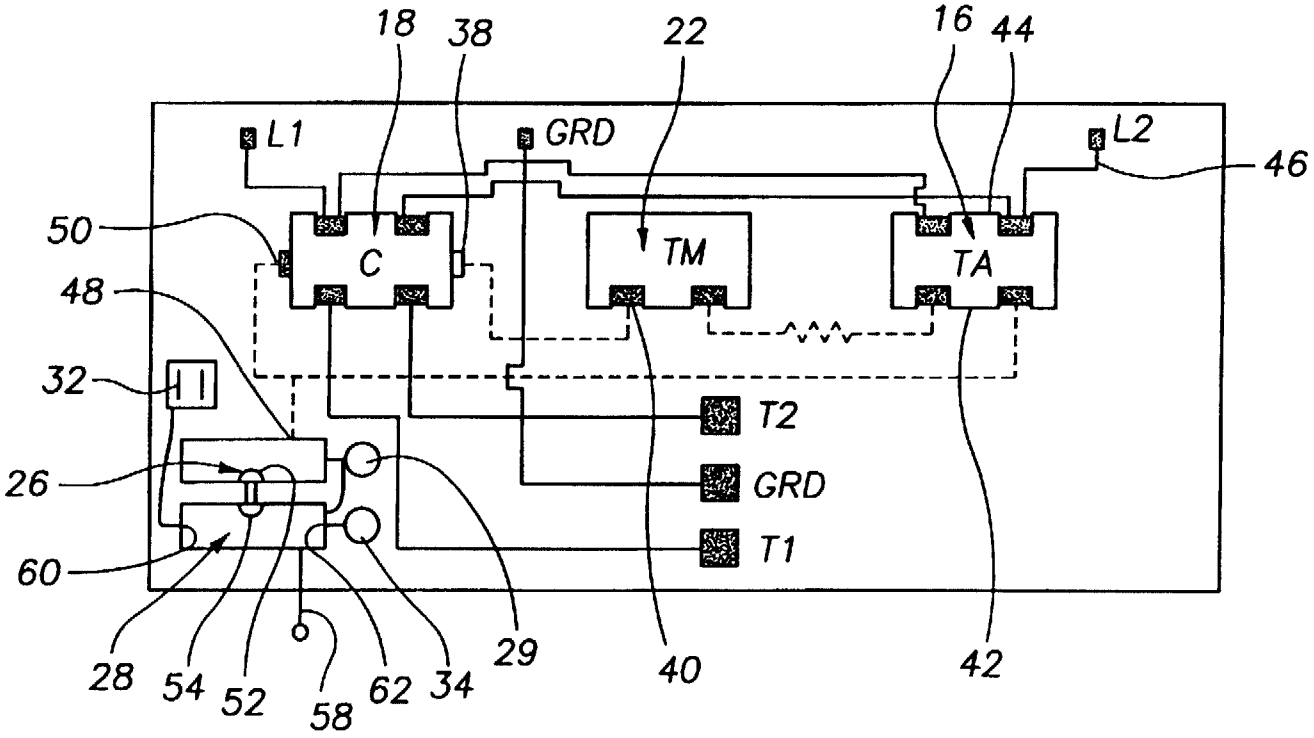
FIG. 3 is a schematic diagram showing interconnection of the electrical components of the power interruption detector of FIG. 1.

Referring to FIG. 2, power input cord 14 is a conventional three conductor electrical cord rated for the desired line voltage. Similarly, power plug receptacle 20 is a standard NEMA configuration power socket selected for the desired appliance or electrically powered device to be operated. In this embodiment, power plug receptacle 20 and power input cord 14 are selected for 3-prong, 110 Volt use. Power contactor 18 is a standard 30 amp contactor with two poles for switching the hot line and the neutral line to the wiring terminals of power plug receptacle 20 when an actuating coil 38 (FIG. 3) is energized by a delay timer output 40. Delay timer 22 is a conventional five minute delay on power up timed solid state relay switch. Delay timer 22 is electrically connected to a 24-Volt secondary winding 42 of a conventional multi-volt transformer 16. The 110-Volt primary winding 44 of multi-volt transformer 16 is wired to the hot line 46 of power input cord 14. When line power is interrupted because of a power failure or brown out delay timer 22 resets, de-energizing actuating coil 38, opening power contactor 18, and disconnecting power plug receptacle 20 from line power. After the five minute delay period has elapsed, delay timer 22 energizes actuating coil 38, closing power contactor 18 and reconnecting power plug receptacle 20 to power. Counting circuit 26, combined visual digital trip counter display driver and alarm circuit 28, audible alarm enunciator 34, visual seven segment display 30 and thumb wheel switch 32 are powered by battery 29. Counting circuit 26, combined visual digital trip counter display driver and alarm circuit 28, audible alarm enunciator 34, visual seven segment display 30 and thumb wheel switch 32, and battery 29 are all conventional components. Counting circuit 26 has a counting input 48 coupled to the one of the terminals 50 of actuating coil 38. Each time actuating coil 38 is energized, counter circuit 26 increments one increment on a set of counter output lines 52. Counter output lines 52 are connected to a set of data input lines 54 of combined visual digital trip counter display driver and alarm circuit 28. Combined visual digital trip counter display driver and alarm circuit 28 drives visual seven segment display 30 (FIG. 1) through a display output 58. Visual seven segment display 30 (FIG. 1) displays in Arabic numerals one less than the binary value placed on counter output lines 52. Thus, on power up, visual seven segment display will display a zero when counter output lines have a binary value of one.

Combined visual digital trip counter display driver and alarm circuit 28 includes limit inputs 60 that are connected to thumb wheel switch 32 and an alarm output 62 connected to audible alarm enunciator 34. Alarm output 62 activates audible alarm enunciator 34 when one more than the numeric value dialed on thumb wheel switch 32 is reached by the binary value on counter output lines 26. Because counting circuit 26, Combined visual digital trip counter display driver and alarm circuit 28, audible alarm enunciator 34, visual seven segment display 30 and thumb wheel switch 32 are powered by battery 29, power outages and brown outs do not reset counting circuit 26 allowing the correct number of power outages or brown outs to be displayed.

Power interruption detector 10 is used by connecting power input line 14 to line power through direct wiring or the use of a standard plug and then plugging the desired equipment into power plug receptacle 20.

It can be seen from the preceding description that a power interruption detector has been provided that has an automatic reset circuit that includes a delay timer; that reapplies power to a power outlet after a predetermined delay period has expired since reapplication of power to the detector; that includes an alarm circuit that provides an audible alarm when a predetermined number of power interruptions have been detected; that includes a power interruption trip counter display that provides a visual display of the number of power interruptions detected by the power interruption detector since the last trip counter reset; and that includes an alarm circuit that provides an audible alarm when a predetermined number of power interruptions have been detected and an alarm set input that allows the user to select the predetermined number of power interruptions from a range of values.

It is noted that the embodiment of the power interruption detector described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A power interruption detector comprising:

a housing;

a power input cord;

a multi-volt transformer having a 120-208-240 primary winding and a 24 volt secondary winding;

a power contactor with an actuating coil;

a power plug receptacle;

a delay timer;

a counting circuit;

an alarm circuit;

a thumb-wheel switch;

a digital trip counter display driver;

a display output device;

an audible alarm enunciator; and a battery;

said power input cord coupling line power to said primary winding of said multi-volt transformer and to a first terminal side of said power contactor, a second terminal side of said power contactor being wired to receptacle terminals of said power plug receptacle;

said power contactor having normally open contacts that close to complete an electrical circuit between said power input cord and said power plug receptacle when said actuating coil is energized;

said secondary winding being coupled to said delay timer;

said delay timer having a delay timer output coupled to said actuating coil of said contactor;

said delay timer having internal circuitry that causes said delay timer output to energize said actuating coil of said contactor a predetermined delay period after said delay timer input detects current flow through said secondary winding;

said counting circuit having a counting input coupled to an actuating coil terminal of said actuating coil in a manner such that each time said actuating coil is energized said counting circuit increments one increment on a plurality of counter output lines, said counter output lines being connected to a like plurality of data input lines of said digital trip counter display driver;

said digital trip counter display driver driving said display output device in a manner such that said display output device visually displays in Arabic numerals the binary value of said plurality of counter output lines minus one;

said alarm circuit having an alarm output connected to an activation input of said audible alarm enunciator and an alarm input connected to an output of said thumb wheel switch;

said alarm output activating said audible alarm enunciator when one more than a numeric value dialed on said thumb wheel switch is reached by said plurality of counter output lines; said battery powering said counting circuit, said alarm circuit, said thumb-wheel switch, said digital trip counter display driver, said display output device, and said audible alarm enunciator.

2. The power interruption detector of claim 1, wherein: said housing is molded from plastic.

3. The power interruption detector of claim 1, wherein: said delay timer is a delay on power up timed solid state relay switch.

* * * * *